US010907454B2

(12) United States Patent
Stachowiak, Jr. et al.

(10) Patent No.: US 10,907,454 B2
(45) Date of Patent: Feb. 2, 2021

(54) POLISHED ROD LINER ASSEMBLY

(71) Applicant: Weatherford Technology Holdings, LLC, Houston, TX (US)

(72) Inventors: John E. Stachowiak, Jr., Houston, TX (US); Jason W. Bailey, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 16/392,051

(22) Filed: Apr. 23, 2019

(65) Prior Publication Data

US 2020/0340336 A1 Oct. 29, 2020

(51) Int. Cl.

| | |
|---|---|
| ***E21B 43/12*** | (2006.01) |
| ***E21B 17/10*** | (2006.01) |
| *F04B 47/02* | (2006.01) |

(52) U.S. Cl.

CPC ..... *E21B 43/126* (2013.01); *E21B 17/1007* (2013.01); *F04B 47/026* (2013.01)

(58) Field of Classification Search

CPC ..... E21B 33/08; E21B 17/1007; E21B 43/13; E21B 43/126

See application file for complete search history.

(56) References Cited

U.S. PATENT DOCUMENTS

| | | | | |
|---|---|---|---|---|
| 2,069,443 A | | 2/1937 | Hill | |
| 2,179,814 A | | 11/1939 | Conaghan | |
| 3,662,829 A | | 5/1972 | Gault et al. | |
| 3,983,632 A | | 10/1976 | Halstead | |
| 4,890,671 A | | 1/1990 | Baxtrer | |
| 5,137,083 A | * | 8/1992 | Bump | E21B 33/072 166/80.1 |
| 5,346,004 A | * | 9/1994 | Borden | E21B 23/01 166/86.1 |

(Continued)

FOREIGN PATENT DOCUMENTS

CA 2237835 A1 11/1999

OTHER PUBLICATIONS

American Petroleum Institute, "Specification for Sucker Rods, Polished Rods and Liners, Couplings, Sinker Bars, Polished Rod Clamps, Stuffing Boxes, and Pumping Tees," API Specification 11B, 27th ed., May 2010, 106-pgs.

(Continued)

*Primary Examiner* — Shane Bomar
(74) *Attorney, Agent, or Firm* — Blank Rome LLP

(57) ABSTRACT

A liner assembly is used for a polished rod of a reciprocating pump movable through a stuffing box. A liner sleeve positions on the polished rod and has an external thread on its distal ends. Roots of the external thread increase in depth in the external circumferential surface along the length toward the distal end. A nut positions on the polished rod and has internal thread configured to thread to the external thread of the liner sleeve. A head positions on the polished rod. The head is configured to engage the polished (e.g., with clamping or fastening), and the head is configured to affix to the nut (e.g., with thread or with flanges and fasteners). A gasket positions on the polished rod between the nut and the head. The gasket is held between a nose of the nut and a smooth bore relief of the head or is held between reliefs on the nut and head.

21 Claims, 10 Drawing Sheets

(56) References Cited

U.S. PATENT DOCUMENTS

| | | | | |
|---|---|---|---|---|
| 5,484,024 | A | 1/1996 | Ladd et al. | |
| 5,549,156 | A | 8/1996 | Borden | |
| 6,135,670 | A | 10/2000 | Bahnman et al. | |
| 9,140,113 | B2 | 9/2015 | Hurst et al. | |
| 2001/0050168 | A1* | 12/2001 | Hult | E21B 43/121 166/68.5 |
| 2011/0266005 | A1* | 11/2011 | Hult | E21B 43/126 166/378 |
| 2012/0011912 | A1 | 1/2012 | Flegel et al. | |
| 2013/0269927 | A1* | 10/2013 | Woods | E21B 33/08 166/84.2 |
| 2019/0032471 | A1* | 1/2019 | Puls | E21B 47/009 |

OTHER PUBLICATIONS

Precision International, "Liner—Polished Rod," Brochure, copyright 2017, 1-pg.

Weatherford, "Surface Pumping Units," Catalogue, copyright 2014-2018, 28-pgs.

PRL Manufacturing Products, "Polished Rods, Polished Rod Liners, Heads," obtained from prlmfg.com, copyright 2020, 3-pgs.

Int'l Search Report received in copending PCT Application No. PCT/US2020/023715 dated Jul. 15, 2020, 11 pages.

* cited by examiner

POLISHED ROD LINER ASSEMBLY

BACKGROUND OF THE DISCLOSURE

Reciprocating pump systems, such as sucker rod pump systems, extract fluids from a well and employ a downhole pump connected to a driving source at the surface. A rod string connects the surface driving force to the downhole pump in the well. When operated, the driving source cyclically raises and lowers the downhole pump, and with each stroke, the downhole pump lifts well fluids toward the surface.

For example, FIG. 1 shows a reciprocating pump system 10 used to produce fluid from a well. A downhole pump 14 has a barrel 16 with a standing valve 24 located at the bottom. The standing valve 24 allows fluid to enter from the wellbore, but does not allow the fluid to leave. Inside the pump barrel 16, a plunger 20 has a traveling valve 22 located at the top. The traveling valve 22 allows fluid to move from below the plunger 20 to the production tubing 18 above, but does not allow fluid to return from the tubing 18 to the pump barrel 16 below the plunger 20. A driving source (e.g., a pump jack or pumping unit 30) at the surface connects by a rod string 12 to the plunger 20 and moves the plunger 20 up and down cyclically in upstrokes and downstrokes.

At the surface, the pump jack 30 is driven by a prime mover and crank assembly 32 that connects by pitman arms 34 to the rearward end of a walking beam 36 supported at a fulcrum point 35 of a frame 31. A horsehead 36 mounted on the forward end of the walking beam 36 connects by a flexible wire rope bridle 39*a* to a carrier bar 39*b*, upon which a polished rod 15 is suspended. The polished rod 15 extends through packing glands of a stuffing box 13 at the wellhead. The rod string 12 of sucker rods hangs from the polished rod 15 within the tubing string 18 located within the well casing and extends to the downhole pump 14.

To preserve the polished rod from wear, a polished rod liner 40 can be disposed on the exterior of the polished rod 15 and can be held with a clamp 50. The polished rod liner 40 extends through the packing glands of the stuffing box 13 and provides a suitable wear surface for the rubbing action of the packing glands within the stuffing box 13. Due to its greater diameter, the liner 40 can also reduce leakage from the stuffing box 13. The liner 40 at least measures the maximum the stroke length of the pumping unit with some additional length.

Because the liner 40 is used as a wear surface and is not used as a coupling for the polished rod 15 and the rod string 12, the liner 40 does not need to be made of a high strength material. Instead, a better wear resistant material can be used for the liner 40.

To be effective, however, the liner 40 needs to seal the annular space between the liner 40 and the polished rod 15 so that hydrocarbons capable of passing up the annulus do not leak out from above the stuffing box 13. Typically, sealing of the annular space is achieved at the liner clamp 50.

Various types of liner clamps 50 have been used to affix and seal the liner 40 to the polished rod 15. Some typical styles of clamps 50 include an S-head, an R-head, and a C-head.

FIGS. 2A-2C illustrates an S-head style clamp 50A used for many years to affix and seal the liner 50 to the polished rod 15. The clamp 50A includes lower and upper members 60, 70 that affix the liner 40 on the polished rod 15. As is typical, the liner 40 has a bore 42 and positions over the polished rod 15. The lower head member 60 has an internal passage 62 that slips over the polished rod 15 and threads with an internal thread 64 onto an external thread 44 on the end of the liner 40. A gasket 74 positions on the polished rod 15, and the internal passage 72 of the upper head member 70 positions on the polished rod 15. Internal thread 76 of the upper member 70 then threads to external thread 66 on the lower member 60 to squeeze the gasket 74, and several side fasteners 78 are tightened on the upper member 70 to engage the polished rod 15.

The arrangement in FIG. 2B is a threaded form of the S-head where the lower head member's thread 64 affixes onto the liner's thread 44 without more being used for affixing. By contrast, the arrangement in FIG. 2C is a welded form of the S-head. Here, the lower head member's thread 64 affixes onto the liner's thread 44. However, this arrangement provides for welding (not shown) of the lower head member 60 to the liner 40 at the lower end 61 of the nut 60. The weld is used to affix the nut 60 to the liner 40 and is not typically rated for sealing.

FIG. 2D illustrates a cross-sectional view of conventional thread 44 used on the distal end of the liner 40. The thread 44 includes crests 45 and roots 47 that spiral around the liner's outer circumference. One typical outer diameter (OD) for the liner 40 is 1.312-in. For this size, the external thread 44 on the distal end of the liner 40 may be formed with 18 threads-per-inch (TPI). This produces a 1.232-minor diameter (MD) of the liner 40 at the nose.

Another typical outer diameter (OD) for the liner 40 is 1.375-in. For this size, the external thread 44 on the distal end of the liner 40 is formed with 16 TPI. This produces a 1.299-minor diameter (MD) of the liner 40 at the nose. As will be appreciated, the liner 40 is a thin walled sleeve so that reduction of the thickness (OD-ID) to form the thread 44 can weaken the liner 40 structurally.

FIGS. 3A-3B illustrates an R-head style clamp 50B used for many years to affix and seal the liner 40 to the polished rod 15. The clamp 50B includes lower and upper head members 60, 70 that affix the liner 40 on the polished rod 15. Again, the liner 40 has a bore 42 and positions over the polished rod 15. The lower head member 60 has an internal passage 62 that slips over the polished rod 15 and threads with an internal thread 64 onto an external thread 44 on the end of the liner 40. A gasket 74 positions on the polished rod 15, and the internal passage 72 of the upper head member 70 positions on the polished rod 15. Fasteners 79 on flange ears 65, 75 affix the upper and lower members 60, 70 together to squeeze the gasket 74, and several side fasteners 78 are tightened on the upper member 70 to engage the polished rod 15.

FIGS. 4A-4B illustrates a C-head style clamp 50C used for many years to affix and seal the liner 40 to the polished rod 15 is a C-head style clamp 50C. The clamp 50C includes lower and upper members 60, 70 that affix the liner 40 on the polished rod 15. Again, the liner 40 has a bore 42 and positions over the polished rod 15. The lower head member 60 has an internal passage 62 that slips over the polished rod 15 and threads with an internal thread 64 onto an external thread 44 on the end of the liner 40. A gasket 74 positions on the polished rod 15, and the internal passage 72 of the upper head member 70 positions on the polished rod 15. Fasteners 79*a* on flange ears 65, 75 affix the upper and lower members 60, 70 together to squeeze the gasket 74, and several side fasteners 79*b* are tightened to clamp separate pieces 71*a-b* of the upper member 70 around the polished rod 15.

During normal operation, fluid pressure can travel up from the well in the annulus between the liner 40 and the polished rod 15 and may leak out at the clamp 50A-C.

Leakage can also occur should the polished rod 15 break due to failure. Although these S, R, and C-head style clamps 50A-C may be effective for attaching the liner 40 on the polished rod 15, they have shortcomings with respect to sealing. Typically, the clamps 50A-C can only hold pressure of about 600-psi and may even have leak paths that can only hold pressure at a significantly lower value. Issues with sealing are complicated by the fact that the liner is a thin-walled tube, which limits options for sealing.

The subject matter of the present disclosure is directed to overcoming, or at least reducing the effects of, one or more of the problems set forth above.

SUMMARY OF THE DISCLOSURE

According to the present disclosure, a liner assembly is used for a polished rod movable through a stuffing box of a reciprocating pump. The assembly comprises a liner, a nut, a head, and a gasket.

In a first configuration, the liner has a distal end and defines an inner bore, which is configured to position on the polished rod. An external circumferential surface of the liner defining a first external thread.

The nut has first and second ends and defines a first internal passage, which is configured to position on the polished rod and a portion of the liner. The first internal passage defines a first internal thread that is configured to thread to the first external thread of the liner. The first internal thread and the first external thread comprise a sealing threaded connection providing sealing.

The head has third and fourth ends and defines a second internal passage, which is configured to position on the polished rod. The head is configured to engage the polished rod, and a second portion of the head is configured to affix to a first portion of the nut. The gasket is configured to position on the polished rod between the nut and the head.

In a first arrangement, the first portion of the nut can comprise an outer surface of the nut defining a second external thread, while the second portion of the head can comprise a second internal thread defined in the second internal passage and being configured to thread to the first external thread of the nut.

For this first arrangement, the nut can comprise a nose disposed at the second end extending beyond the second external thread. The second internal passage of the head can define a smooth bore disposed between the second internal thread and the fourth end. The gasket can be configured to position on the polished rod between the nose at the second end of the nut and the smooth bore of the second internal passage of the head.

For this first arrangement, the first internal thread can be defined on an intermediate portion of the first internal passage. A first portion of the first internal passage toward the first end can define a first smooth bore, while a second portion of the first internal passage toward the second end can define a second smooth bore.

In a second arrangement, the first internal passage of the nut can define a first relief thereabout at the second end, while the second internal passage can define a second relief thereabout at the third end. The gasket can be configured to position on the polished rod between the first relief of the nut and the second relief of the head.

For this second arrangement, the head can define at least one cross hole being configured to receive at least one fastener for engaging the polished rod positioned through the second internal passage of the head. Alternatively, the head can comprise at least two separate parts being configured to clamp together with at least one fastener around the polished rod. Either way, the first and second portions can comprise first and second flanges, each defining at least one hole being configured to receive at least one fastener for affixing the first and second flanges together.

According to the present disclosure, the sealing threaded connection can comprise the first external thread deepening along a length of the external circumferential surface toward the distal end. Roots of the first external thread can increase in depth in the external circumferential surface at an inclination along the length toward the distal end.

For this sealing threaded connection, the first internal thread can be tapered along the first internal passage of the nut and can be defined at a taper to match the inclination. In an alternative, the first internal thread can be straight along the first internal passage.

For this sealing threaded connection, a major diameter of the first external thread can match an outer diameter of the liner, and a minor diameter of the first external thread can decrease along the length based on the inclination. The external circumferential surface of the liner can define a constant outer diameter, and crests of the first external thread can terminate at the outer diameter along the length of the first external thread toward the distal end. The length of the first external thread can be greater than a partial length of the first external thread at which the first external thread makes hand-tight engagement with the first internal thread.

In addition to this sealing threaded connection, the assembly can use other sealing threaded connections disclosed herein.

In a second configuration of a liner assembly according to the present disclosure for a polished rod movable through a stuffing box of a reciprocating pump, the assembly comprises a liner, a nut, a head, and a gasket. The liner has a distal end and defines an inner bore, which is configured to position on the polished rod. An external circumferential surface of the liner defines a first external thread.

The nut has first and second ends and defines a first internal passage, which is configured to position on the polished rod and a portion of the liner. The first internal passage defines a first internal thread that is configured to thread to the first external thread of the liner. An outer surface of the nut defines a second external thread. The first internal thread and the first external thread comprise a sealing threaded connection providing sealing.

The head has third and fourth ends and defines a second internal passage, which is configured to position on the polished rod and a portion of the nut. The second internal passage defines a second internal thread being configured to thread to the first external thread of the nut. The gasket is configured to position on the polished rod between the second end of the nut and the second internal passage of the head.

Further features of this second configuration can be similar to those discussed above with respect to the first configuration.

In a third configuration of a liner assembly according to the present disclosure for a polished rod movable through a stuffing box of a reciprocating pump, the assembly comprises a liner, a nut, a head, and a gasket. The liner has a distal end and defines an internal bore, which is configured to position on the polished rod. An external circumferential surface of the liner defines a first external thread.

The nut has a first flange and has first and second ends. The nut defines a first internal passage configured to position on the polished rod and a portion of the liner. The first internal passage defines a first internal thread that is configured to thread to the first external thread of the liner. The first internal thread and the first external thread comprise a sealing threaded connection providing sealing.

The head has a second flange and has third and fourth ends. The head defines a second internal passage being configured to position on the polished rod. The gasket is configured to position on the polished rod between the nut and the head. At least one first fastener is configured to affix the first and second flanges together, and at least one second fastener is configured to engage the head on the polished rod.

The first and second flanges can each define at least one hole configured to receive the at least one first fastener for affixing the first and second flanges together. The head can comprise: at least one cross hole configured to receive the at least one second fastener for engaging the polished rod positioned through the second internal passage of the head; or at least two separate parts configured to affix together around the polished rod, the at least two separate parts defining cross holes configured to receive the at least one second fastener for clamping the first and second parts on the polished rod.

The first internal passage of the nut can define a first relief thereabout at the second end, and the second internal passage of the head can define a second relief thereabout at the third end. The gasket can be configured to position on the polished rod between the first relief of the nut and the second relief of the head.

The second relief can define an inward taper radially compressing the gasket about the liner.

Further features of this second configuration can be similar to those discussed above with respect to the first configuration.

The foregoing summary is not intended to summarize each potential embodiment or every aspect of the present disclosure.

DETAILED DESCRIPTION OF THE DISCLOSURE

Figure 5B:
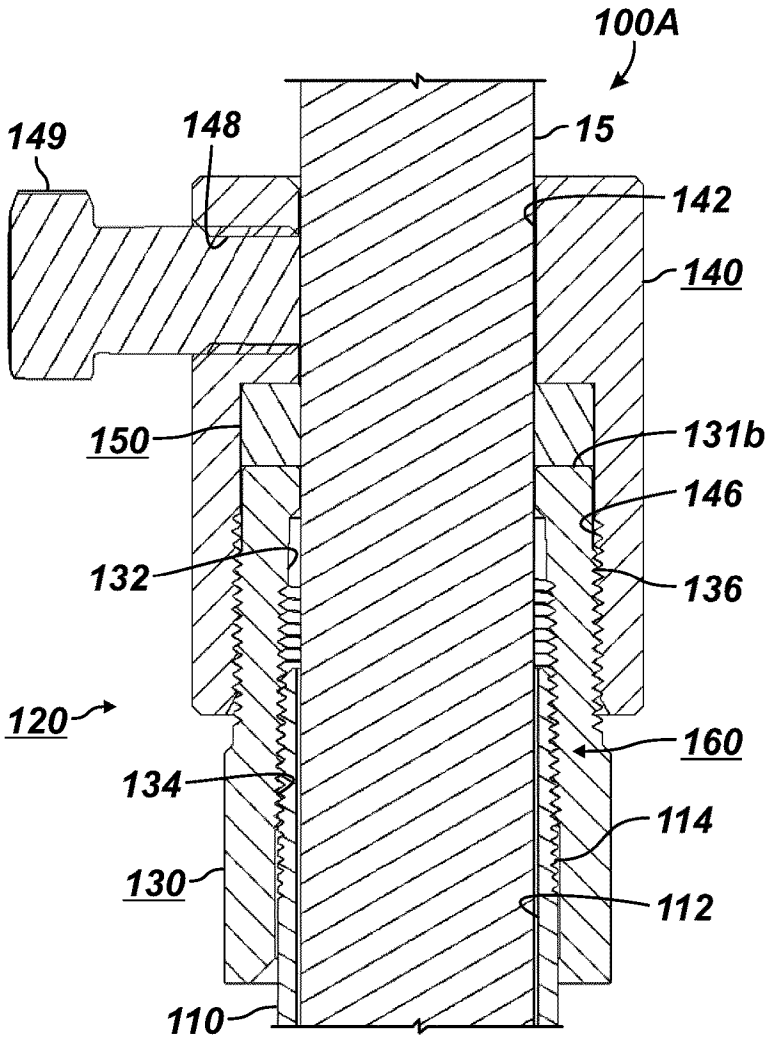
FIGS. 5A-5B illustrate an exploded perspective view and an assembled cross-sectional view of an assembly having a liner and a S-head style clamp according to the present disclosure.
Figure 5A:
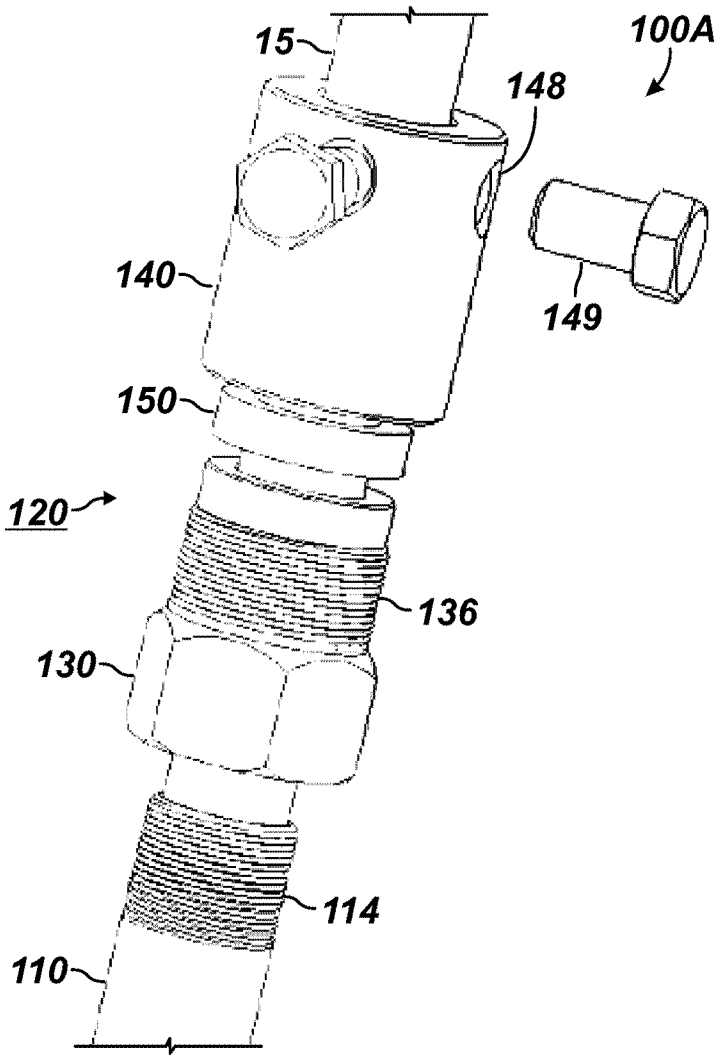
Figure 5C:
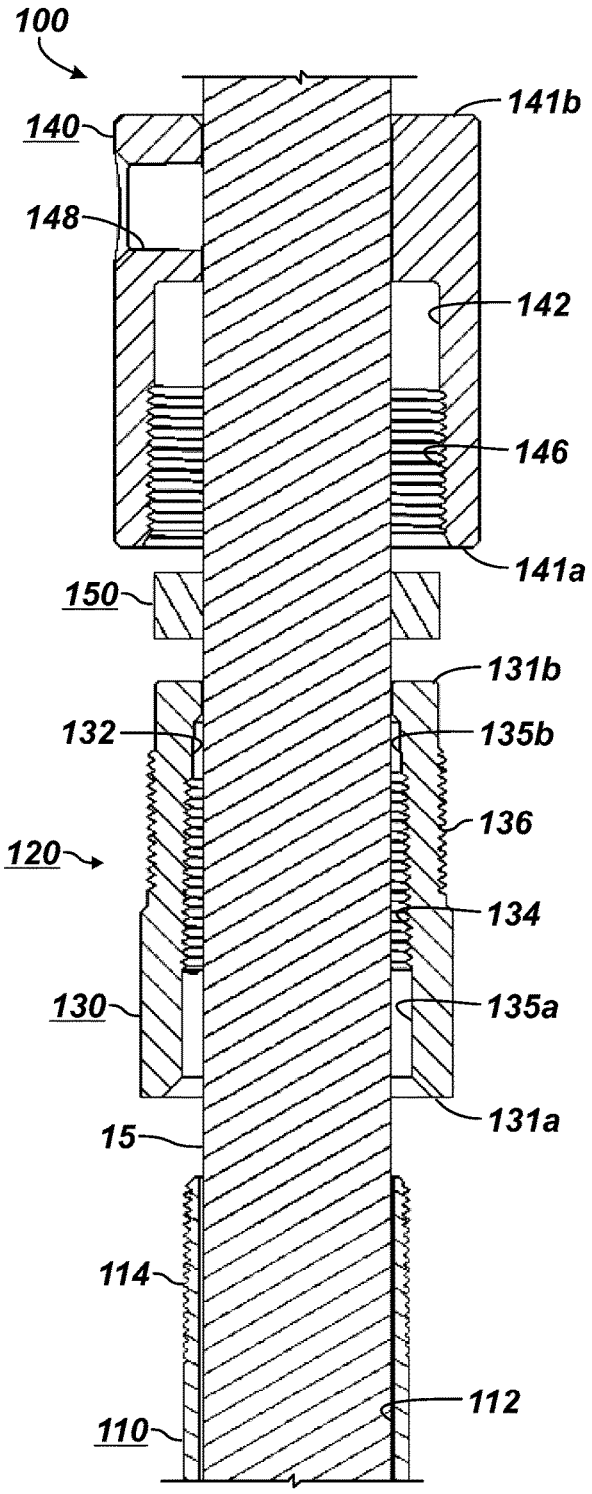
FIG. 5C illustrates an exploded cross-sectional view of the assembly.
Figure 5D:
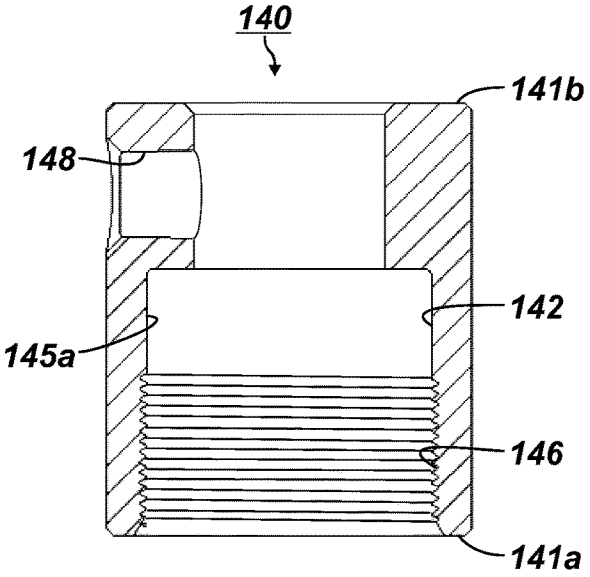
FIG. 5D illustrates a cross-sectional view of the head of the clamp.

FIGS. 5A-5C illustrate a liner assembly 100A according to the present disclosure used for a polished rod 15. FIG. 5A shows the liner assembly 100A in an exploded perspective view, while FIG. 5B shows the liner assembly 100A in an assembled cross-sectional view. FIG. 5C shows the liner assembly 100A in an exploded cross-sectional view.

The assembly 100A includes a liner 110 and includes a clamp 120 similar to an S-Head style clamp. The clamp 120 includes a nut 130, a head 140, and a gasket 150.

The liner assembly 100A is used for the polished rod 15 of a reciprocating pump system (not shown), such as described previously. The liner 110 is affixed to the polished rod 15 with the clamp 120, and the liner 110 is movable through a stuffing box (not shown), which typically has a maximum working pressure. For example, some stuffing boxes have working pressures of 1500-psi or higher. As noted previously, current designs of liners and clamps are not capable of a pressure rating that reaches toward such working pressures. However, this assembly 100A as well as the others of the present disclosure can be directed to operating at a target working pressure of at least 1500 psi and may be directed to a rating as high as 2250 psi.

The liner 110 is a sleeve having an upper end and defining an inner bore 112. The sleeve's inner bore 112 is configured to position on the polished rod 15 with a close clearance. An external thread 114 is defined on the external circumferential surface of the liner's upper end. As shown in FIG. 5B and as will be described in more detail below, the external thread 114 is configured to thread to internal thread 134 of the nut 130 to form a sealing threaded connection (160). In a particular example of the connection (160) disclosed herein, the external thread 114 is a deepening thread defined with increasing depth at an inclination angle along a length toward the liner's end.

The nut 130 is a lower head member of the clamp 120. As best shown in FIG. 5C, the nut 130 has first (lower) and second (upper) ends 131*a-b* and defines a first internal passage 132, which is configured to position on the polished rod 15 and a portion of the liner 110. An outer surface of the nut 130 defines a second external thread 136. Inside the passage 132, an intermediate portion of the internal circumferential surface defines a first internal thread 134. As noted above, the internal thread 134 is configured to thread to the first external thread 114 of the liner sleeve 110 with the sealing threaded connection (160; FIG. 5B).

A first portion of the first internal circumferential surface toward the first end 131*a* defines a first smooth bore surface 135*a*. A second portion of the first internal circumferential surface toward the second end 131*b* defines a second smooth bore surface 135*b*.

As best shown in FIG. 5C, the head 140 has third (lower) and fourth (upper) ends 141*a*-*b* and defines a second internal passage 142. The second internal passage 142 is configured to position on the polished rod 15 and a portion of the nut 130. The head 140 is an upper head member of the clamp 120. As shown in FIG. 5B, the head 140 defines at least one cross hole 148 configured to receive a fastener 149 for engaging the polished rod 15 positioned through the second internal passage 142 of the head 140.

The second internal passage 142 defines a second internal thread 146 toward the lower end 141*a* configured to thread to the first external thread 136 of the nut 130. The head's internal passage 142 also defines a third smooth bore surface 145*a* between the head's internal thread 146 and the upper end 141*b*.

Figure 5E:
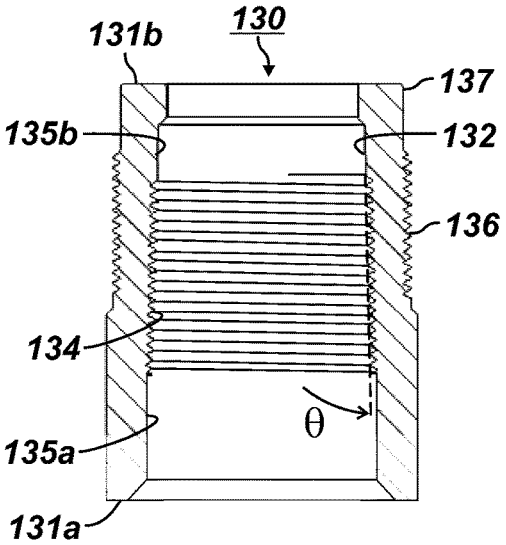
FIG. 5E illustrates a cross-sectional detail of the nut of the clamp of the assembly.

As shown in FIGS. 5B-5C, the gasket 150 is configured to position on the polished rod 15 between the end 131*b* of the nut 130 and the second internal passage 142 of the head 140. The external thread 136 of the nut 130 as best shown in FIG. 5E is spaced from the upper end 131*b* by a nose 137, which engages the seal 150 as shown in FIG. 5B. In this way, the gasket 150 is compressed in the smooth bore 145*a* of the head 140 by the nose 137 of the nut 130.

Figure 2C:
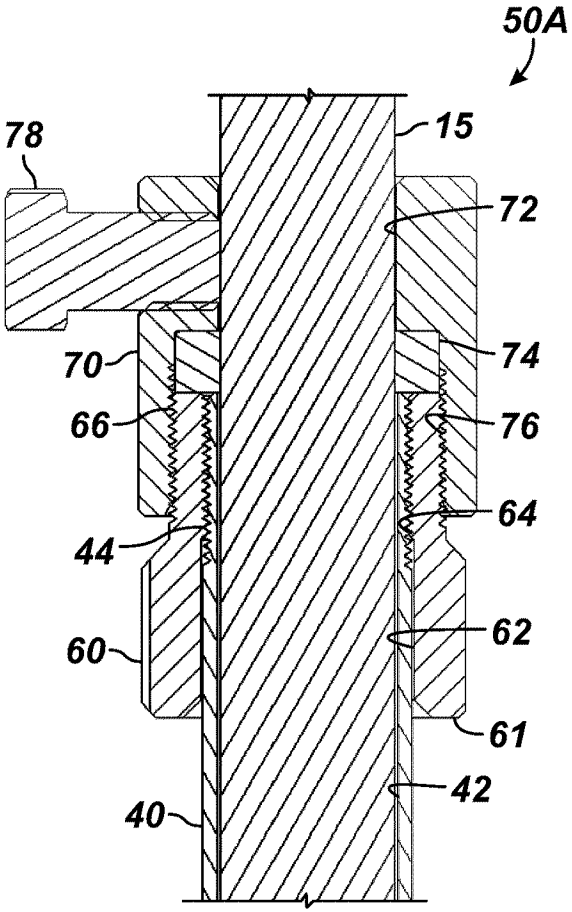
FIG. 2C (Prior Art)
FIG. 2C illustrates an assembled cross-sectional view of another arrangement of the S-head assembly according to the prior art.
Figure 2B:
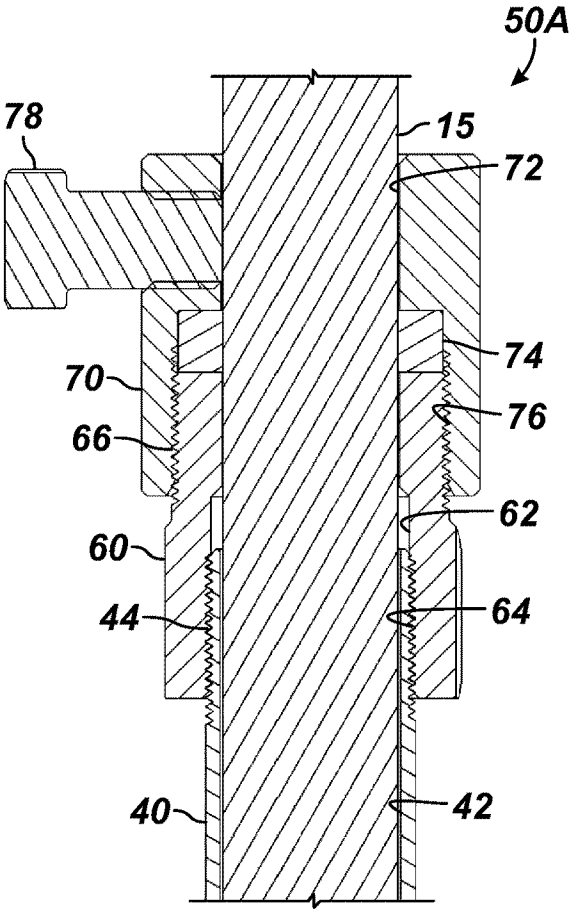
FIG. 2B (Prior Art)
FIGS. 2A-2B illustrate an assembled perspective view and an assembled cross-sectional view of an assembly having a liner and a S-head style clamp according to the prior art.
Figure 2A:
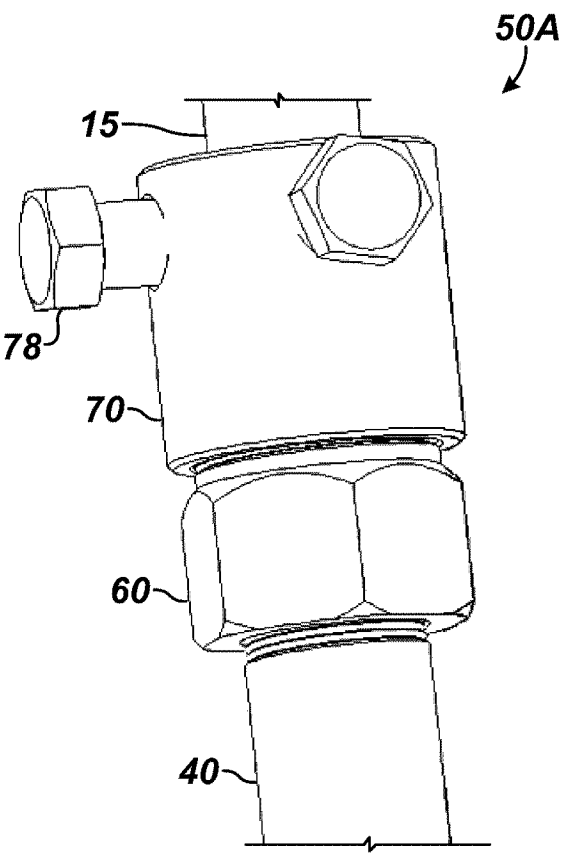
FIG. 2A (Prior Art)
Figure 3B:
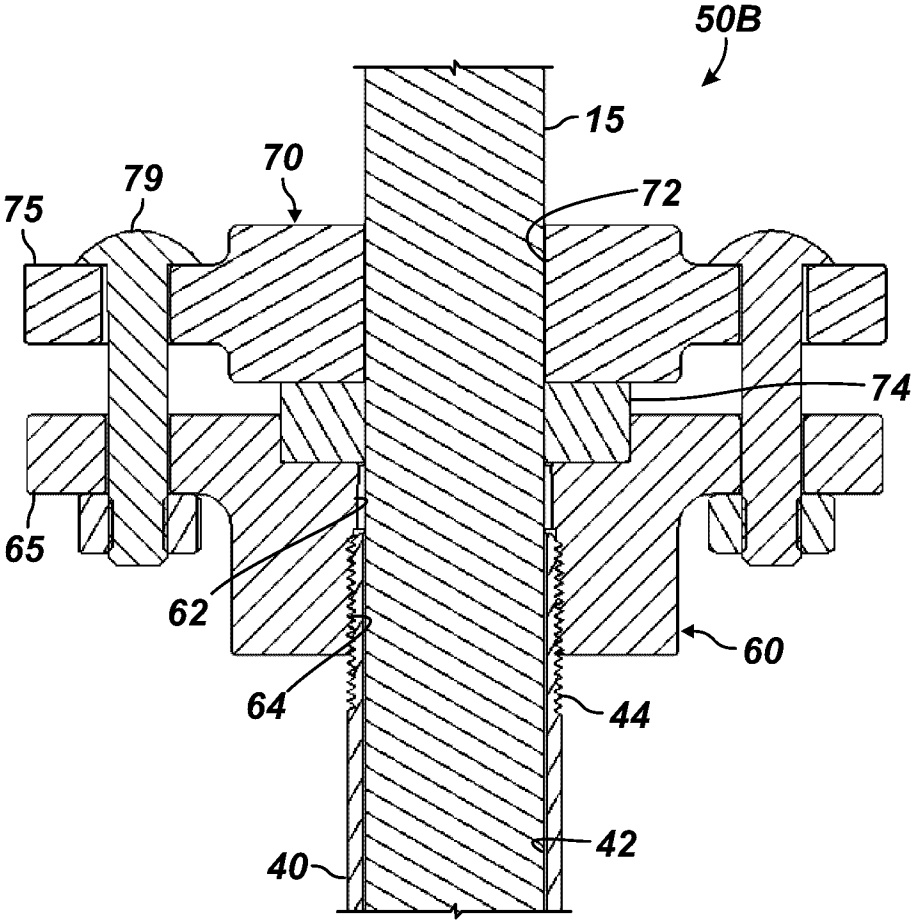
FIG. 3B (Prior Art)
FIGS. 3A-3B illustrate an exploded perspective view and an assembled cross-sectional view of an assembly having a liner and a R-head style clamp according to the prior art.
Figure 3A:
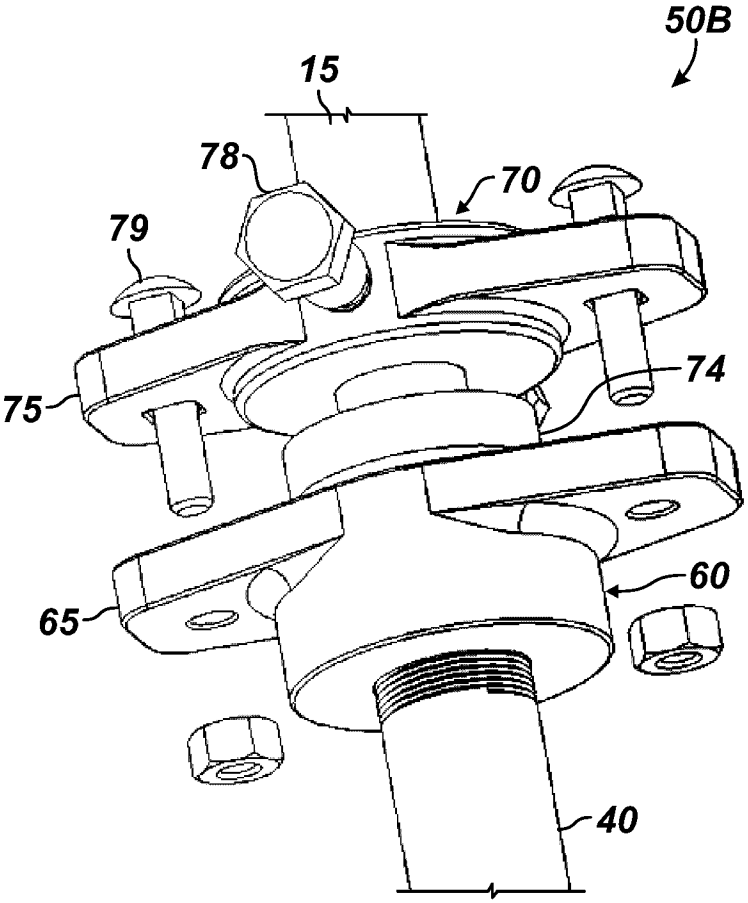
FIG. 3A (Prior Art)
Figure 4B:
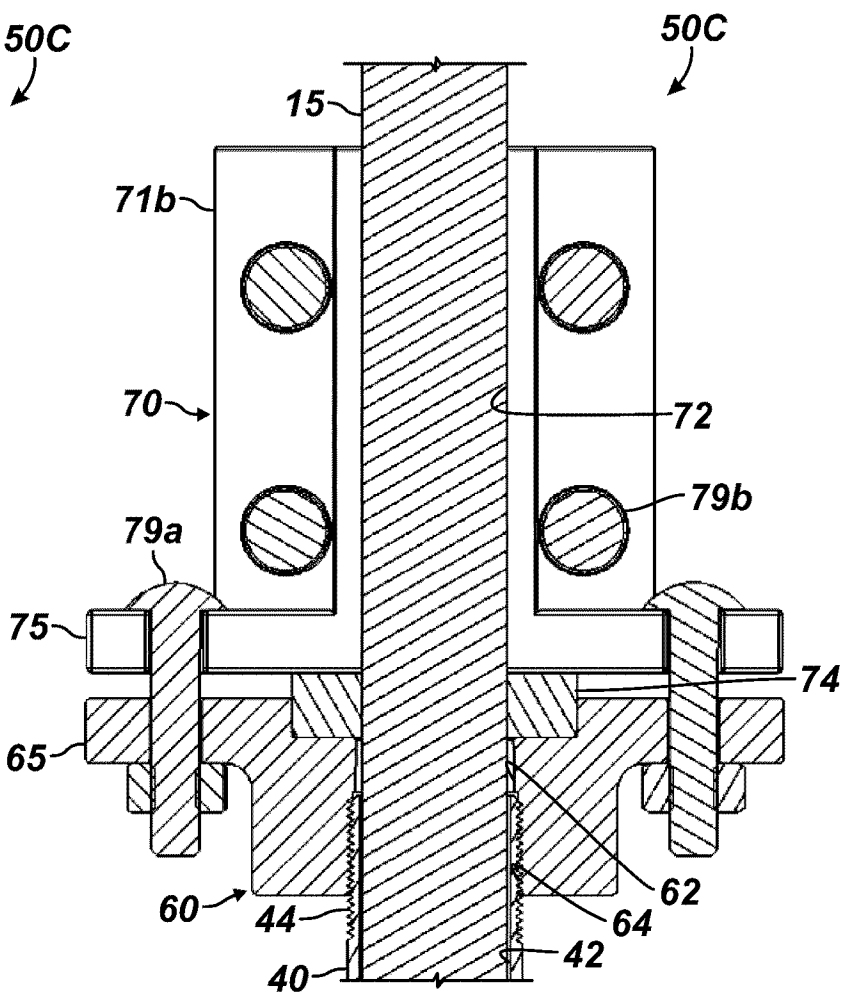
FIG. 4B (Prior Art)
FIGS. 4A-4B illustrate an exploded perspective view and an assembled cross-sectional view of an assembly having a liner and a C-head style clamp according to the prior art.
Figure 4A:
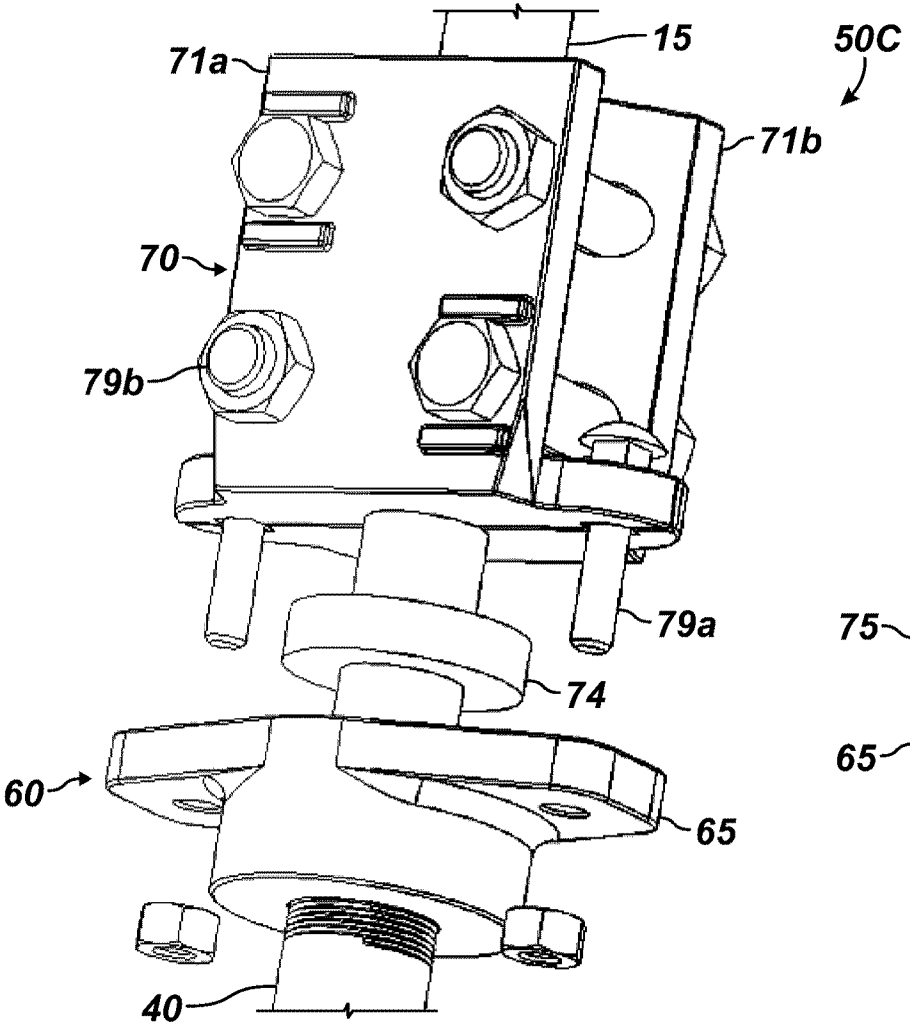
FIG. 4A (Prior Art)

In particular, the seal surface or relief 145*a* of the head 140 offers a smooth cylindrical surface for surrounding the captured gasket 150, and the nose 137 of the nut 130 pilots the captured gasket 150 into this seal surface or relief 145*a* when squeezing the gasket 150 between the head 140 and nut 130. This is in direct contrast to the typical sealing of a gasket in a S-head style clamp of the prior art, such as discussed previously with respect to FIGS. 2A-2C. Conventionally, the gasket (74) must seal at least partially against internal thread (76) of the upper head member (70), which results in poor sealing.

As further shown in FIG. 5E, the internal passage 132 of the nut 130 includes an internal smooth surface or relief 135*a* toward the lower end 131*a*. This surface 135*a* separating the end 131*a* from the internal thread 134 allows a weld to be added to the gap between the nut's lower end 131*a* surrounding the liner (110) to further affix (and potentially seal) the nut 130 to the liner (110). Accordingly, this arrangement allows the singular-styled nut 130 to be used for thread only attachment and for the combined thread-weld attachment to the liner 110, which is different from the two different lower head members used in the prior art of FIGS. 2B-2C.

Figure 1:
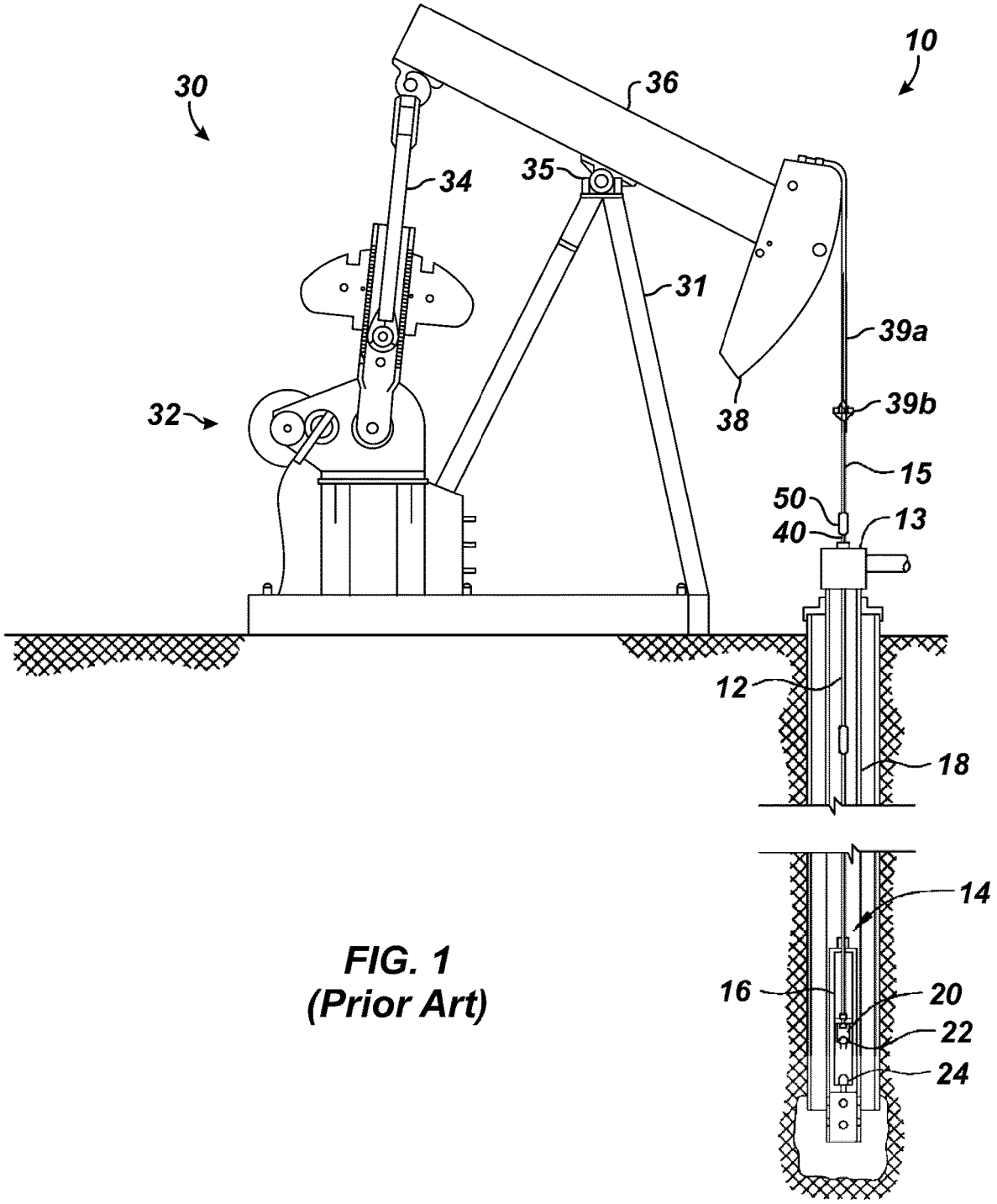
FIG. 1 (Prior Art)
FIG. 1 illustrates a reciprocating rod system according to the prior art having a liner supported on a polished rod with a clamp.

As shown in FIG. 5E, the nut 130 defines a consistent thickness along its length, lacking external reliefs or recesses of reduced diameter. At times, maintenance may be performed on the pump jack, or the spacing of the sucker rod pump may be adjusted. In these situations, the rod string (12) may be hung from the polished rod clamp (39*b*: FIG. 1) so that the liner clamp 120 may be trapped and compressed between the stuffing box (13) and the polished rod clamp (39*b*). The consistent thickness of the nut 130 allows the nut 130 to support greater axial load without collapsing during such an event.

Figure 5F:
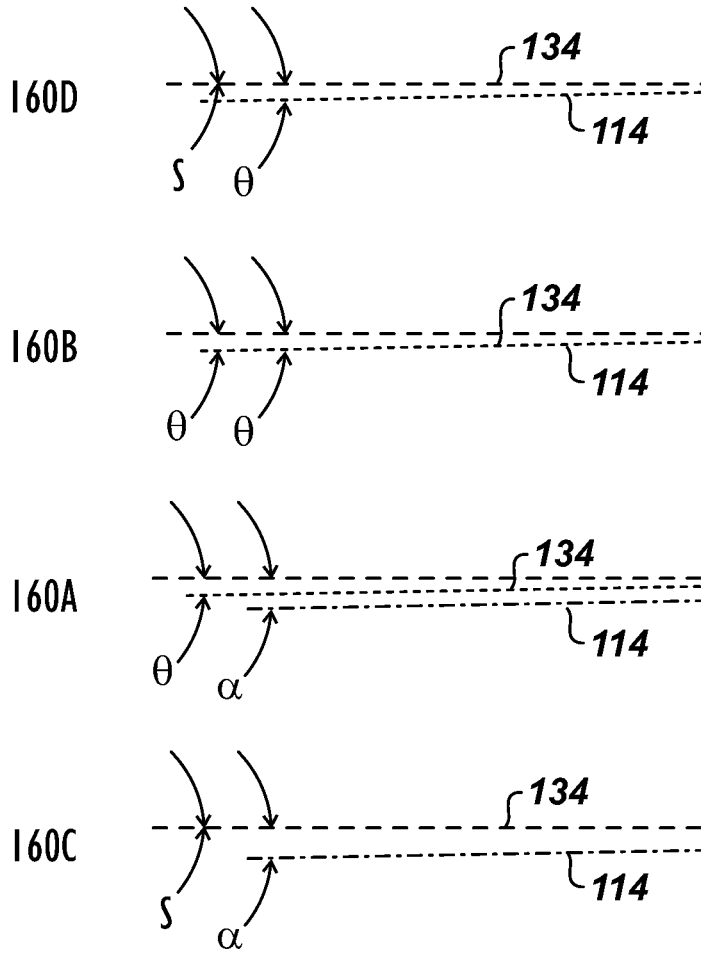
FIG. 5F illustrates configurations for sealing threaded connections between the liner and the nut according to the present disclosure.

Finally, the internal thread 134 is shown in the central passage 132 between the smooth surfaces 135*a*-*b*. The internal thread 134 as noted herein is configured to thread to the external thread (114) of the liner (110) for sealing engagement. FIG. 5F illustrates configurations for sealing threaded connections 160 according to the present disclosure for sealing engagement.

In a first configuration of a sealing threaded connection 160A, the external thread 114 defines a deepening thread at an inclination (α), and the internal thread 134 defines a tapered thread at a taper (θ) to produce sealing engagement. In a second configuration of a sealing threaded connection 160B, the external thread 114 defines a tapered thread at a taper (θ), and the internal thread 134 defines a tapered thread at a taper (θ) to produce sealing engagement.

In a third configuration of a sealing threaded connection 160C, the external thread 114 defines a deepening thread a deepening thread at an inclination (α), and the internal thread 134 defines a straight thread at no taper (S) to produce sealing engagement. In a fourth configuration of a sealing threaded connection 160D, the external thread 114 defines a tapered thread at a taper (θ), and the internal thread 134 defines a straight thread at no taper (S) to produce sealing engagement.

In additional configurations, either one of the external thread 114 and the internal thread 134 can define a deepening thread at an inclination (α) or a tapered thread at a taper (θ), while the other defines a deepening thread at an inclination (α), a tapered thread at a taper (θ), a straight thread at no taper (S). Each of these configurations produce a sealing threaded connection 160 for sealing engagement as disclosed herein.

As disclosed herein, a tapered thread is a thread having roots and crests formed on a tapered (angled) surface. However, as provided in more detail below, the deepening thread is different from such a tapered thread and includes a thread having roots formed at a deepening depth in a cylindrical outer surface.

For example, according to the first configuration of the sealing threaded connection 160A in which the internal thread 134 defines a tapered thread, the internal thread 135 can be formed at a taper (θ), which may be 1.78-deg. for a 1.312-in diameter liner or may be 2.38-deg. for a 1.375-in diameter liner.

Figure 5H:
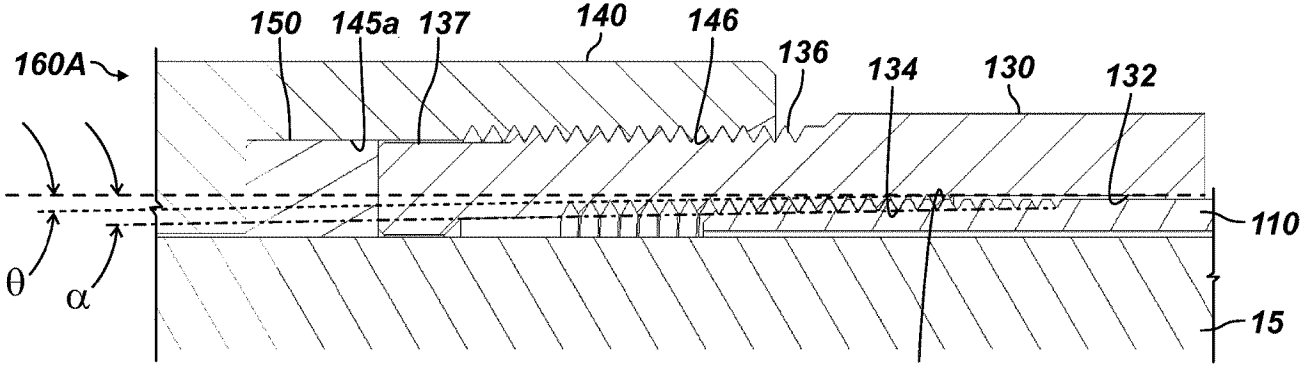
FIG. 5H illustrates a detail view of the deepening thread of the liner threaded to the tapered thread of the nut.
Figure 5G:
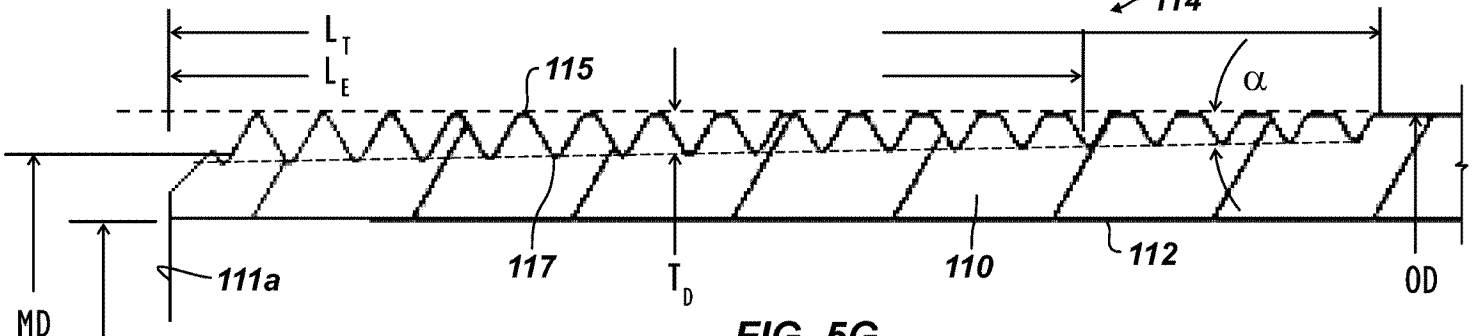
FIG. 5G illustrates a detailed view of the deepening thread for the liner.
Figure 2D:
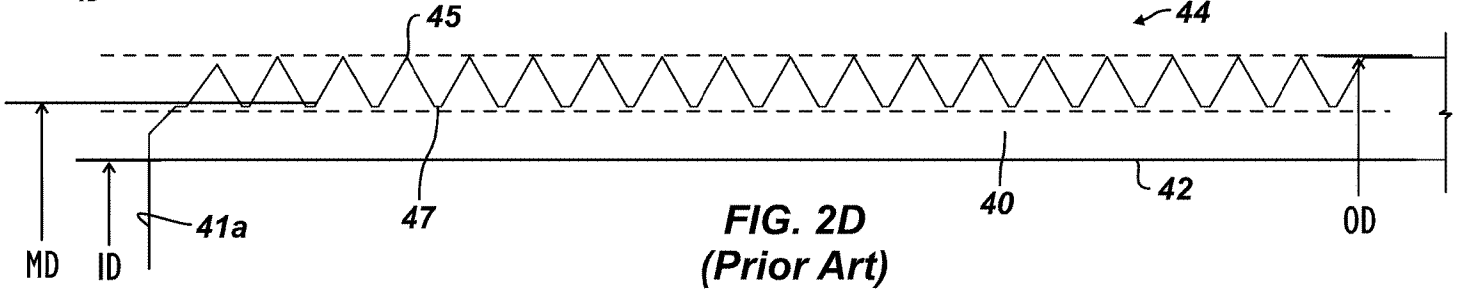
FIG. 2D (Prior Art)
FIG. 2D illustrates a conventional thread used on the distal end of a liner.

Additionally, according to the first configuration 160A in which the external thread 114 defines a deepening thread, the external thread 114 can be configured as detailed in FIG. 5G. As shown and noted previously, the external thread 114 is defined at a deepening thread depth $T_D$ on the external circumferential surface of the liner sleeve's upper end. In particular, the thread 114 extends along a length (L) on the end of the liner 110. The extent of flanks of the thread 114 increase so that the roots 117 of the thread 114 are defined at an increasing depth starting at a small depth and eventually increasing to a full depth at the liner's distal end 111*a*. The depth of the roots 117 increases at an inclination (α) along the length (L) of the thread 114 to the end of the liner 110.

The crests 115 of the thread 114, however, are not inclined or tapered. Instead, the crests 115 start as truncated to the outer circumference (OD) of the liner 110. The crests 115 finish as complete crests toward the distal end 111*a* of the liner 110. In that sense, the major diameter of the thread 114 at the crests 115 is the same as (or is at least close to) liner's diameter (OD). Meanwhile, the minor pitch diameter (MD) of the thread 114 at the roots 117 decreases along the length (L) with the inclination (α). Therefore, rather than just being a tapered thread formed on a tapered end of the liner, the external thread 114 is a deepening thread as disclosed herein.

The deepening thread 114 that increases at an inclination (α) mates with the internal thread (134) that is defined at a taper (θ). For instance, FIG. 5H illustrates a detail view of the deepening thread 114 of the liner 110 threaded to the tapered thread 134 of the nut 130 in the first configuration of sealing threaded connection 160A. As disclosed herein, the deepening thread 114 threads to the internal thread 134 of the clamp's nut 130 to form a sealed engagement to prevent leakage of well pressure. The tapered thread 134 includes roots and crests formed on the taper (θ) of the internal circumference of the nut's internal passage 132. The sealed engagement between the threads 114, 134 may prevent leakage from well pressure that is present in the annulus between the liner 110 and the polished rod (15).

As is known, thread is typically characterized by a pitch, crests, roots, flanks, flank angle, minor diameter, major diameter, and effective pitch diameter. The values for these characteristics for the deepening thread 114 can depend on the overall diameter (OD) of the liner 110. As noted previously, one typical diameter (OD) for the liner 110 is 1.312-in. For this size, the thread length ($L_T$) for the external thread 114 can be 1.2-in, and the external thread 114 can be formed with 18 TPI. The thread 114 can have a 0.9-in length for a hand-tight engagement length ($L_E$) with the nut (130). In that case, the hand-tight engagement length ($L_E$) can be about 75% of the total thread length ($L_T$).

For this size, the thread 114 can be formed at a 0.375-in taper-per-foot (TPF) (i.e., an inclination (α) of about 1.78 deg.). For this inclination (α), the minor pitch diameter (MD) at the hand-tight engagement length ($L_E$) can be about 1.250-in, whereas the minor pitch diameter (MD) at the nose 111*a* can be approximately 1.245-in. This deepening thread 114 that increases in depth at the inclination (α) of 1.78 deg. can be configured to mate with the internal thread (136) that is defined at a taper (θ) of 1.78 deg.

As noted previously, another typical diameter (OD) for the liner 110 is 1.375-in. The thread length ($L_T$) for the thread 114 can be 1.2-in, and the thread 114 can be formed with 16 TPI. The thread 114 can have a 0.9-in length for a hand-tight engagement length ($L_E$).

For this size, the thread 114 can be formed at a 0.50-in taper-per-foot (TPF) (i.e., an inclination (α) of about 2.38 deg.). For this inclination (α), the minor pitch diameter (MD) at the hand-tight engagement length ($L_E$) can be about 1.336-in, whereas the minor pitch diameter (MD) at the nose can be approximately 1.286-in. This increasing depth thread 114 that increases at the inclination (α) of 2.38 deg. can be configured to mate with the internal thread (136) that is defined at a taper (θ) of 2.38 deg.

As will be appreciated, these and other values can be used for the characteristics of the external thread 114 as disclosed herein and can be configured for a particular implementation. Overall, the mating of the internal nut thread (134) with the external liner thread 114 is intended to create not only a mechanical connection, but to create a pressure seal that can withstand a level at least up to 1,500 psi, but other values are possible.

Moreover, the deepening thread 114 allows the liner 110 at its distal end 111*a* to maintain additional thickness. As noted herein, the liner 110 is a thin-walled tube, and the deepening thread 114 provides the liner 110 with benefits for both strength and sealing. For instance, the smaller 16 TPI is used on the 1.312-in liner 110 to produce a wider thread. The smaller TPI for this sized liner 110 is preferred for strength because more of liner's wall thickness can be maintained. (A larger TPI results in narrower thread). Additionally, the wall thickness of the liner 110 at the last (male) engaged thread for this deepening thread 114 is greater than would be available from a straight thread. This can provide greater strength during side-loading on the liner 110. For example, the annulus between the polished rod 15 and liner 110 can be greater than shown in the drawings, and the liner 110 may experience some side-loading as it passes through the stuffing box. Increased wall thickness at the thread 114 can provide more strength.

Figure 6B:
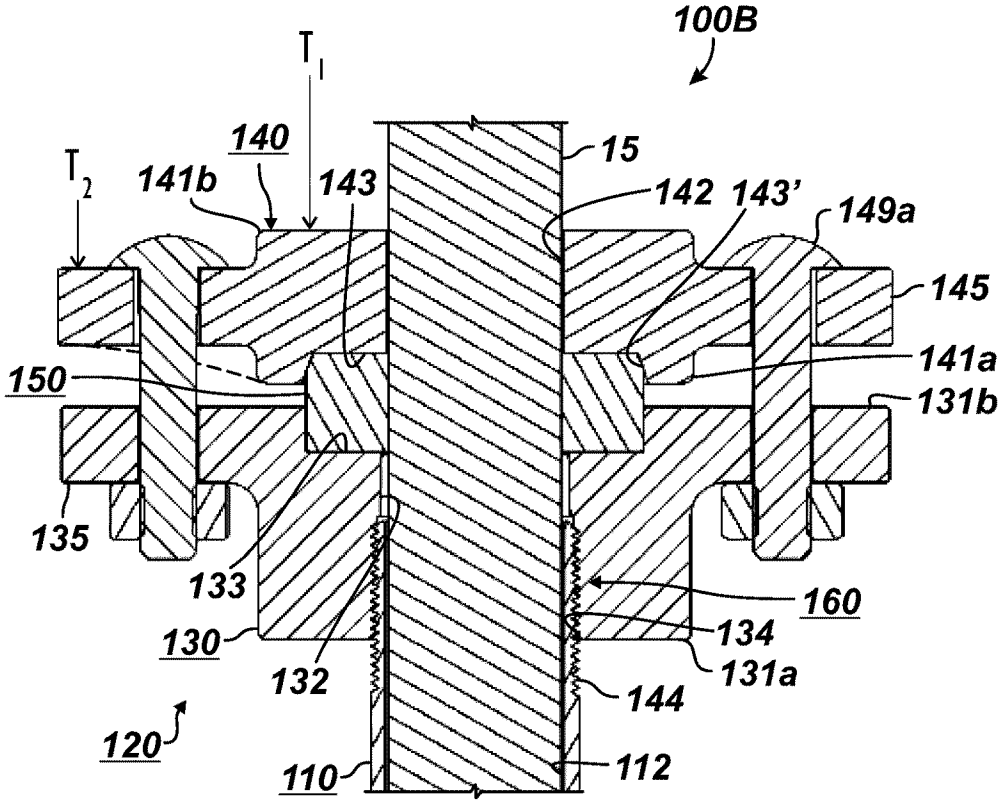
FIGS. 6A-6B illustrate an assembled perspective view and an assembled cross-sectional view of an assembly having a liner and a R-head style clamp according to the present disclosure.
Figure 6A:
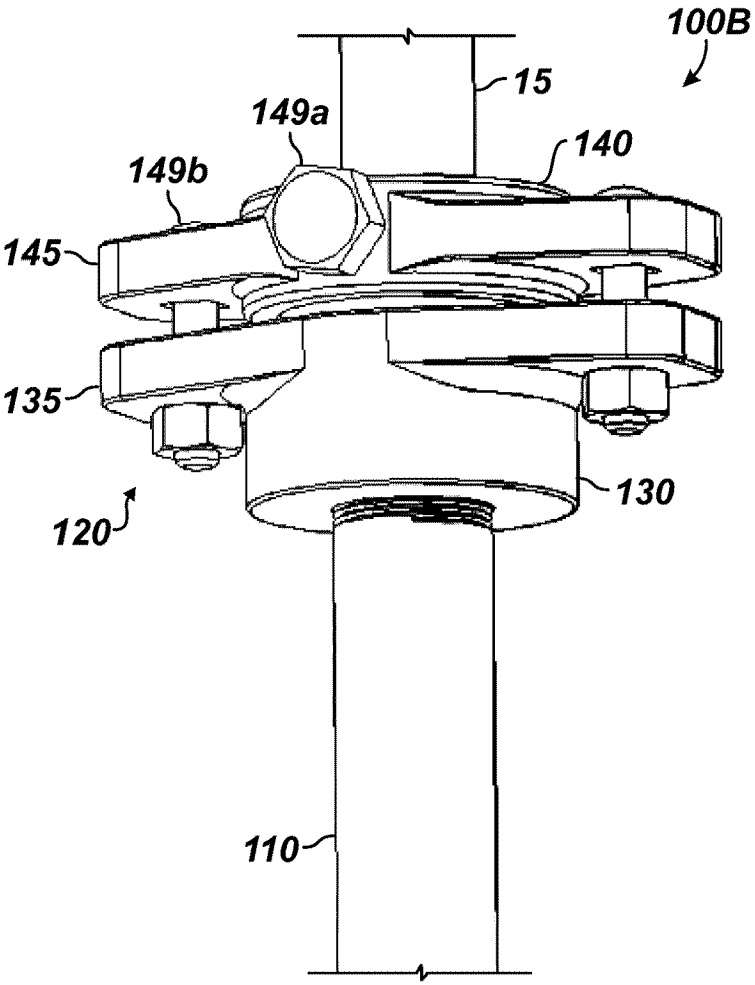

FIGS. 6A-6B illustrate another liner assembly 100B used for a polished rod 15 of a reciprocating pump (not shown) movable through a stuffing box (not shown). FIG. 6A shows the liner assembly 100B in an assembled perspective view, while FIG. 6B shows the liner assembly in an assembled cross-sectional view. The assembly 100B includes a liner sleeve 110 and includes a head 120 similar to an R-Head style clamp. The head 120 includes a nut 130, a head 140, and a gasket 150.

The liner sleeve 110 has an upper end and defines an inner bore 112 configured to position on the polished rod 15. As before, an external circumferential surface of the liner 110 defines a first external thread 114 having a length toward the upper end of the liner 110. The external thread 114 is a deepening thread in a manner similar to that discussed previously with reference to FIG. 5G. Accordingly, roots of the first external thread 114 increases in depth at an inclination (e.g., α) in the external circumferential surface along the length toward the upper end, whereas the crests 115 remain at the outer diameter of the liner's external surface.

The nut 130 has first (lower) and second (upper) ends 131*a-b* and defines a first internal passage 132 configured to position on the polished rod 15 and a portion of the liner 110. The nut 130 has a first flange 135, and the first internal passage 132 defines a first smooth bore surface or relief 133 thereabout at the upper end 131*b*.

At least a portion of the first internal circumferential surface defines a first internal thread 134 configured to thread to the first external thread 114 of the liner sleeve 110. As before, the internal circumferential surface 132 with the internal thread 134 tapers at an angle (e.g., θ) in a manner similar to that discussed previously.

The head 140 has third (lower) and fourth (upper) ends 141*a-b* and defines a second internal passage 142, which is configured to position on the polished rod 15. The head 140 has a second flange 145, and the second internal passage 142 defines a second smooth bore surface or relief 143 thereabout at the lower end 141*a*.

The gasket 150 is configured to position on the polished rod 15 between the first relief 133 of the nut 130 and the second relief 143 of the head 140. The reliefs 133, 143 help circumferentially support the gasket 150 squeezed between the head 140 and the nut 130 to improve sealing. Moreover, the inward taper at the upper corner 143' of the relief 143 in the head 140 can provide greater radial compression to the gasket 150, allowing for higher sealing pressures.

The head 140 defines at least one cross hole (not shown) configured to receive a fastener 149*a* for engaging the polished rod 15 positioned through the second internal passage 142 of the head 140. The first and second flanges 135, 145 each define at least one hole configured to receive a fastener 149*b* for affixing the first and second flanges 135, 145 together and squeeze the gasket 150. Each of the flanges 135, 145 comprise a pair of ears extending from opposite sides of an external surface of the nut 130 and head 140.

As shown in dashed lines of FIG. 6B, each of the ears 145 can define a first thickness $T_1$ toward the external surface of the head 140 that is greater than a second thickness $T_2$ extending away from the external surface. The ears 135 of the nut 130 can be similarly configured. At high pressures of say 2250-psi, the force between the head 140 and the nut 130 can be 6300 lbf. The increased thickness of the ear flanges can help support these loads.

Figure 7B:
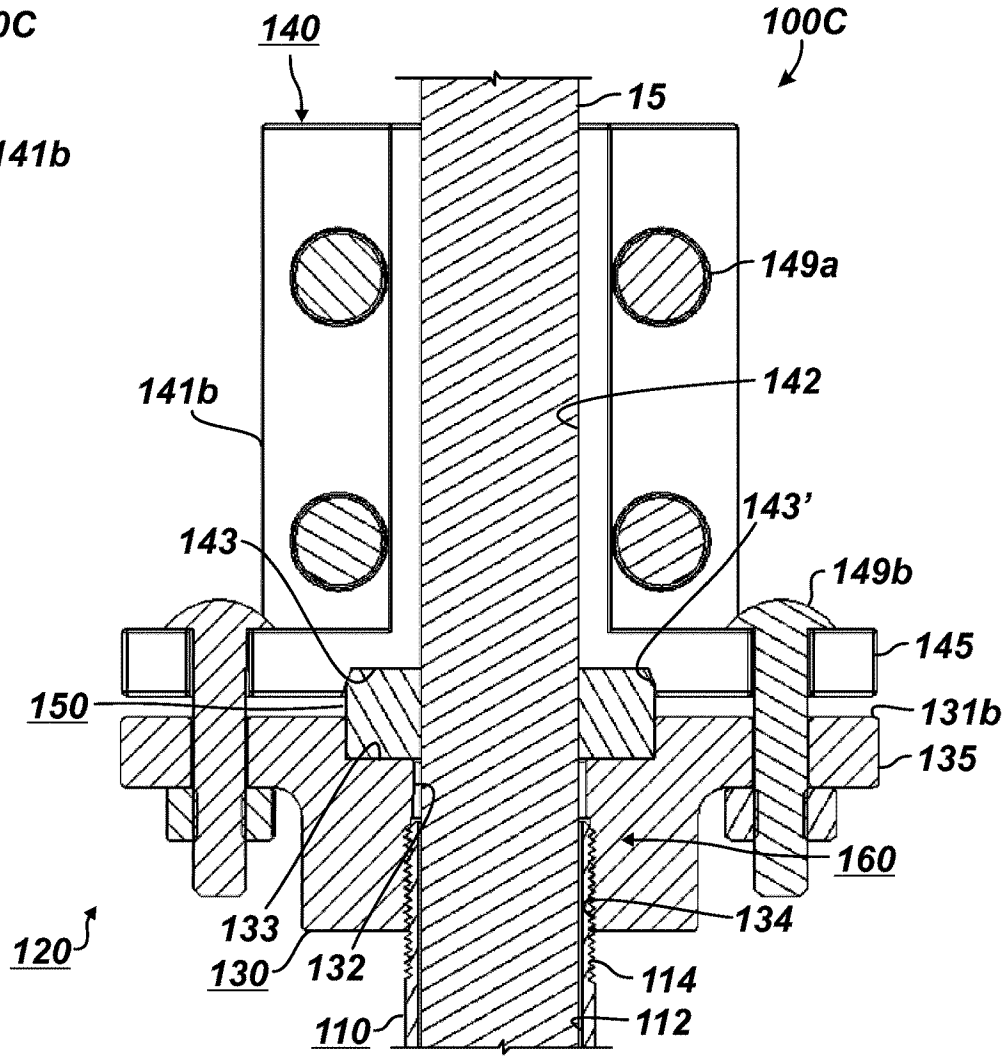
FIGS. 7A-7B illustrate an exploded perspective view and an assembled cross-sectional view of an assembly having a liner and a C-head style clamp according to the present disclosure.
Figure 7A:
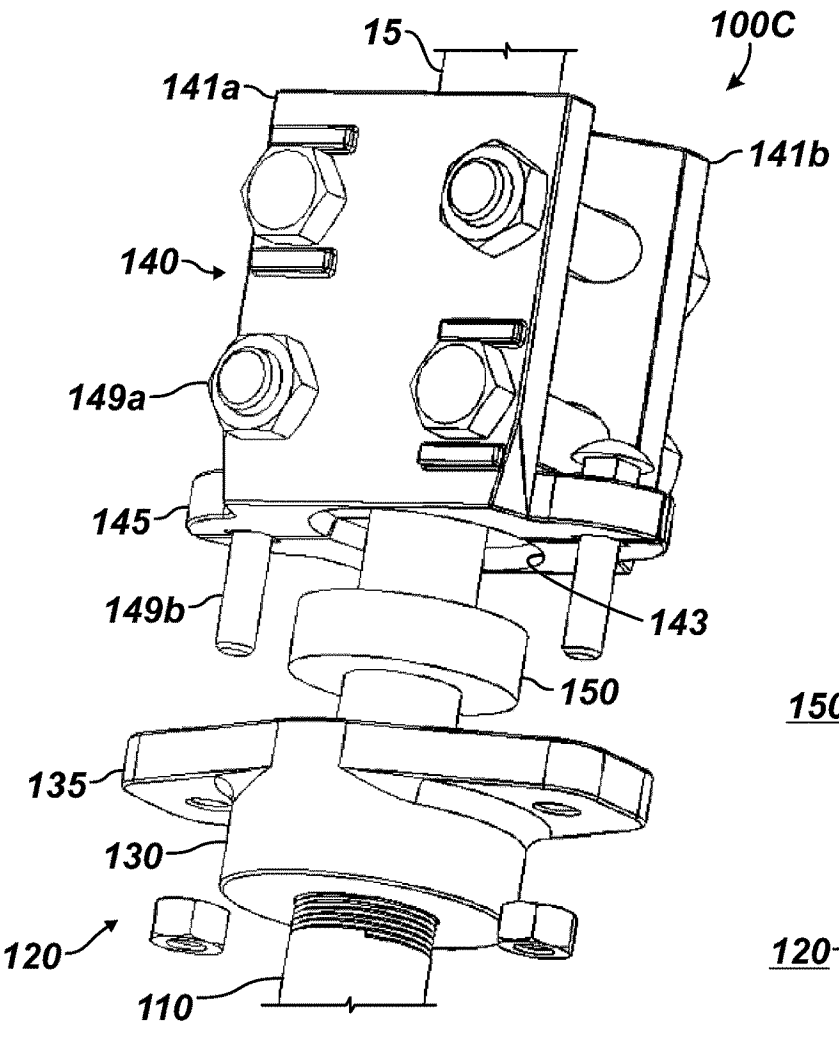

FIGS. 7A-7B illustrate yet another liner assembly 100C used for a polished rod 15 of a reciprocating pump (not shown) movable through a stuffing box (not shown). FIG. 7A shows the liner assembly 100C in an exploded perspective view, while FIG. 7B shows the liner assembly 100C in an assembled cross-sectional view. The assembly 100C includes a liner sleeve 110 and includes a head 120 similar to a C-Head style clamp. The head 120 includes a nut 130, a head 140, and a gasket 150.

The liner sleeve 110 has an upper end and defines an inner bore 112 configured to position on the polished rod 15. As before, an external circumferential surface of the liner 110 defines a first external thread 114 having a length toward the upper end of the liner 110. The external thread 114 is a deepening thread in a manner similar to that discussed previously with reference to FIG. 5G. Accordingly, roots of the first external thread 114 increases in depth at an inclination (e.g., $\alpha$) in the external circumferential surface along the length toward the upper end.

The nut 130 has first (lower) and second (upper) ends 131*a-b* and defines a first internal passage 132 configured to position on the polished rod 15 and a portion of the liner 110. The nut 130 defines a first flange 135, and the first internal passage 132 defines a first smooth bore surface or relief 133 thereabout at the upper end 131*b*

At least a portion of the first internal circumferential surface defines a first internal thread 134 configured to thread to the first external thread 114 of the liner sleeve 110. The internal circumferential surface 132 with the internal thread 134 tapers at an angle (e.g., $\theta$) in a manner similar to that discussed previously.

The head 140 has third (lower) and fourth (upper) ends and defines a second internal passage 142, which is configured to position on the polished rod 15. The head 140 has a second flange 145, and the second internal passage 142 defines a second relief 143 thereabout at the lower end.

The gasket 150 is configured to position on the polished rod 15 between the first relief 133 of the nut 130 and the second relief 143 of the head 140. The reliefs 133, 143 help circumferentially support the gasket 150 squeezed between the head 140 and the nut 130 to improve sealing. Moreover, the inward taper at the upper corner 143' of the relief 143 in the head 140 can provide greater radial compression to the gasket 150, allowing for higher sealing pressures.

The head 140 comprises at least two separate parts 141*a-b* configured to affix with fasteners 149*a* together around the polished rod 15. In particular, the at least two separate parts 141*a-b* define cross holes configured to receive a fastener 149*a* for clamping the first and second parts 141*a-b* on the polished rod 15.

The first and second flanges 135, 145 each define at least one hole configured to receive a fastener 149*b* for affixing the first and second flanges 135, 145 together and squeeze the gasket 150. As before, each of the flanges 135, 145 can comprise a pair of ears extending from opposite sides of an external surface of the nut 130 and the head 140, and the ears can have increased thickness to help support loads.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A liner assembly for a polished rod movable through a stuffing box of a reciprocating pump, the assembly comprising:

a liner having a distal end and defining an inner bore, the inner bore being configured to position on the polished rod, an external circumferential surface of the liner defining a first external thread;

a nut having first and second ends and defining a first internal passage, the first internal passage being configured to position on the polished rod and a portion of the liner, the first internal passage defining a first internal thread, the first internal thread being configured to thread to the first external thread of the liner, the first external thread deepening at an inclination along a length of the external circumferential surface toward the distal end, wherein a major diameter of the first external thread matches an outer diameter of the liner, wherein a minor diameter of the first external thread decreases along the length based on the inclination, wherein the first internal thread and the first external thread comprise a sealing threaded connection providing sealing;

a head having third and fourth ends and defining a second internal passage, the second internal passage being configured to position on the polished rod, the head being configured to engage the polished rod, a second portion of the head being configured to affix to a first portion of the nut; and a gasket being configured to position on the polished rod between the nut and the head.

2. The assembly of claim 1, wherein the first portion of the nut comprises an outer surface of the nut defining a second external thread; and wherein the second portion of the head comprises a second internal thread defined in the second internal passage and being configured to thread to the second external thread of the nut.

3. The assembly of claim 2, wherein the nut comprises a nose disposed at the second end extending beyond the second external thread; wherein the second internal passage of the head defines a smooth bore disposed between the second internal thread and the fourth end; and wherein the gasket is configured to position on the polished rod between the nose at the second end of the nut and the smooth bore of the second internal passage of the head.

4. The assembly of claim 1, wherein the first internal passage of the nut defines a first relief thereabout at the second end; wherein the second internal passage defines a second relief thereabout at the third end; and wherein the gasket is configured to position on the polished rod between the first relief of the nut and the second relief of the head.

5. The assembly of claim 1, wherein the head defines at least one cross hole being configured to receive at least one fastener for engaging the polished rod positioned through the second internal passage of the head; or wherein the head comprises at least two separate parts being configured to clamp together with at least one fastener around the polished rod.

6. The assembly of claim 1, wherein the first and second portions comprise first and second flanges, each defining at least one hole being configured to receive at least one fastener for affixing the first and second flanges together.

7. The assembly of claim 1, wherein roots of the first external thread increase in depth in the external circumferential surface at the inclination along the length toward the distal end.

8. The assembly of claim 1, wherein the sealing threaded connection comprises the first internal thread being tapered along the first internal passage of the nut and being defined at a taper to match the inclination.

9. The assembly of claim 1, wherein the sealing threaded connection comprises the first internal thread being straight along the first internal passage.

10. The assembly of claim 1, wherein the external circumferential surface of the liner defines a constant outer diameter; and wherein crests of the first external thread terminate at the outer diameter along the length of the first external thread toward the distal end.

11. The assembly of claim 1, wherein the length of the first external thread is greater than a partial length of the first external thread at which the first external thread makes hand-tight engagement with the first internal thread.

12. A liner assembly for a polished rod movable through a stuffing box of a reciprocating pump, the assembly comprising:

a liner having a distal end and defining an inner bore, the inner bore configured to position on the polished rod, an external circumferential surface of the liner defining a first external thread;

a nut having first and second ends and defining a first internal passage, the first internal passage configured to position on the polished rod and a portion of the liner, the first internal passage defining a first internal thread, the first internal thread being configured to thread to the first external thread of the liner, an outer surface of the nut defining a second external thread, wherein the first internal thread and the first external thread comprise a sealing threaded connection providing sealing, the nut comprising a nose disposed at the second end extending beyond the second external thread;

a head having third and fourth ends and defining a second internal passage, the second internal passage being configured to position on the polished rod and a portion of the nut, the second internal passage defining a second internal thread being configured to thread to the second external thread of the nut, the second internal passage of the head defining a smooth bore disposed between the second internal thread and the fourth end; and a gasket being configured to position on the polished rod between the nose at the second end of the nut and the smooth bore defined in the second internal passage of the head.

13. The assembly of claim 12, wherein the first internal thread is defined on an intermediate portion of the first internal passage; wherein a first portion of the first internal passage toward the first end defines a first smooth bore; and wherein a second portion of the first internal passage toward the second end defines a second smooth bore.

14. The assembly of claim 12, wherein the first external thread deepens at an inclination along a length of the external circumferential surface toward the distal end; wherein a major diameter of the first external thread matches an outer diameter of the liner; and wherein a minor diameter of the first external thread decreases along the length based on the inclination.

15. The assembly of claim 12, wherein the first external thread deepens at an inclination along a length of the external circumferential surface toward the distal end; wherein the external circumferential surface of the liner defines a constant outer diameter; and wherein crests of the first external thread terminate at the outer diameter along the length of the first external thread toward the distal end.

16. A liner assembly for a polished rod movable through a stuffing box of a reciprocating pump, the assembly comprising:

a liner having a distal end and defining an inner bore, the inner bore being configured to position on the polished rod, an external circumferential surface of the liner defining a first external thread;

a nut having first and second ends and defining a first internal passage, the first internal passage being configured to position on the polished rod and a portion of the liner, the first internal passage of the nut defining a first relief thereabout at the second end, the first internal passage defining a first internal thread, the first internal thread being configured to thread to the first external thread of the liner, wherein the first internal thread and the first external thread comprise a sealing threaded connection providing sealing;

a head having third and fourth ends and defining a second internal passage, the second internal passage being configured to position on the polished rod, the second internal passage defining a second relief thereabout at the third end, the head being configured to engage the polished rod, a second portion of the head being configured to affix to a first portion of the nut; and a gasket being configured to position on the polished rod between the first relief of the nut and the second relief of the head.

17. The assembly of claim 16, the assembly comprising:

the nut having a first flange, the head having a second flange, at least one first fastener being configured to affix the first and second flanges together; and at least one second fastener being configured to engage the head on the polished rod.

18. The assembly of claim 17, wherein the first and second flanges each define at least one hole configured to receive the at least one first fastener for affixing the first and second flanges together; and wherein the head comprises:

at least one cross hole configured to receive the at least one second fastener for engaging the polished rod positioned through the second internal passage of the head; or at least two separate parts configured to affix together around the polished rod, the at least two separate parts defining cross holes configured to receive the at least one second fastener for clamping the first and second parts on the polished rod.

19. The assembly of claim 16, wherein the second relief defines an inward taper radially compressing the gasket about the liner.

20. The assembly of claim 16, wherein the first external thread deepens at an inclination along a length of the external circumferential surface toward the distal end; wherein a major diameter of the first external thread matches an outer diameter of the liner; and wherein a minor diameter of the first external thread decreases along the length based on the inclination.

21. The assembly of claim 16, wherein the first external thread deepens at an inclination along a length of the external circumferential surface toward the distal end;

wherein the external circumferential surface of the liner defines a constant outer diameter; and wherein crests of the first external thread terminate at the outer diameter along the length of the first external thread toward the distal end.

* * * * *